US010807375B2

(12) United States Patent
Osakabe

(10) Patent No.: US 10,807,375 B2
(45) Date of Patent: Oct. 20, 2020

(54) LIQUID SUPPLY APPARATUS AND IMAGE RECORDING APPARATUS

(71) Applicant: BROTHER KOGYO KABUSHIKI KAISHA, Nagoya-shi, Aichi-ken (JP)

(72) Inventor: Yoshinori Osakabe, Seto (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/556,933

(22) Filed: Aug. 30, 2019

(65) Prior Publication Data

US 2020/0070526 A1 Mar. 5, 2020

(30) Foreign Application Priority Data

Aug. 31, 2018 (JP) ..... 2018-163567

(51) Int. Cl.
*B41J 2/175* (2006.01)

(52) U.S. Cl.
CPC ..... *B41J 2/17513* (2013.01); *B41J 2/17553* (2013.01); *B41J 2/17556* (2013.01)

(58) Field of Classification Search
CPC ..... B41J 2/17513; B41J 2/17556; B41J 2/17553; B41J 2/17566; B41J 2/17523; B41J 2/17509; B41J 2002/17579; B41J 29/13
See application file for complete search history.

(56) References Cited

U.S. PATENT DOCUMENTS

| | | | | |
|---|---|---|---|---|
| 2016/0052290 | A1 | 2/2016 | Takahashi et al. | |
| 2016/0297205 | A1 | 10/2016 | Takahashi | |
| 2020/0070528 | A1* | 3/2020 | Ishibe | B41J 2/17553 |
| 2020/0070532 | A1* | 3/2020 | Osakabe | B41J 2/17553 |

FOREIGN PATENT DOCUMENTS

| | | | |
|---|---|---|---|
| JP | 4934338 | B2 | 5/2012 |
| JP | 2016-43604 | A | 4/2016 |
| JP | 2016-159620 | A | 9/2016 |
| WO | 2015/016119 | A1 | 3/2017 |

* cited by examiner

*Primary Examiner* — Sharon A. Polk
(74) *Attorney, Agent, or Firm* — Merchant & Gould P.C.

(57) ABSTRACT

A liquid supply apparatus a tank and a cartridge attachable to the tank along an attachment direction crossing a vertical direction. The ink cartridge includes a first storing chamber configured to store liquid therein. The tank includes a second storing chamber configured to store liquid therein, a liquid channel and an air channel, which both communicate with the second storing chamber. When the cartridge is attached to the tank with the first storing chamber of the cartridge communicating with the liquid channel and the air channel, the first storing chamber has a portion located above the liquid channel and the air channel. The second storing portion has a first area located above a lower end of the first storing chamber of the cartridge in the vertical direction and a second area continuous with the first area and located below the first storing chamber of the cartridge in the vertical direction

7 Claims, 6 Drawing Sheets

LIQUID SUPPLY APPARATUS AND IMAGE RECORDING APPARATUS

CROSS-REFERENCE TO RELATED APPLICATION

This application claims priority from Japanese Patent Application No. 2018-163567 filed on Aug. 31, 2018, the content of which is incorporated herein by reference in its entirety.

TECHNICAL FIELD

Aspects of the disclosure relate to a liquid supply apparatus configured to store liquid therein and an image recording apparatus including the liquid supply apparatus.

BACKGROUND

A known printer includes a liquid supply apparatus. The liquid supply apparatus includes a cartridge to store ink therein, a sub tank connected to a recording head, and a liquid channel and an air channel to connect the cartridge and the sub tank. The cartridge is disposed above the sub tank. The liquid channel and the air channel connect the cartridge and the sub tank in a vertical direction. The liquid channel and the air channel are both open to the lower surface of the cartridge and the upper surface of the sub tank.

In the sub tank, the liquid channel extends downward further than the air channel, and the opening of the liquid channel is located above the opening of the air channel. At the cartridge replacement time, the sub tank is free of ink. When a new cartridge is connected to the sub tank, ink in the cartridge flows down into the sub tank via the liquid channel. Air in the sub tank with the same volume of ink having flowed is brought into the cartridge via the air channel. Such air/liquid replacement continues until the opening of the air channel is closed, and thus ink is stored in the sub tank.

During recording, as ink is ejected from the recording head, ink in the sub tank decreases and the ink level in the sub tank lowers away from the opening of the air channel. As the opening of the air channel is released, ink is supplied from the cartridge to the sub tank. The ink level in the sub tank rises with supply of ink and reaches the opening of the air channel. The opening of the air channel is closed and supply of ink from the cartridge is stopped. To compensate the consumption of ink at the recording head, ink is supplied from the cartridge to the sub tank, and thus the ink level in the sub tank is maintained at the level of the opening of the air channel. The sub tank remains mounted in the printer, and an empty cartridge is replaced with an ink-filled cartridge, so that the printer can be used continuously.

SUMMARY

In the above liquid supply apparatus, the cartridge is connected to the sub tank in a vertical direction, and thus needs attaching to the sub tank in the vertical direction, i.e., from above. Considering workability, the cartridge may be attached from the front of the printer more conveniently than from above.

In response to the above issue, one or more aspects of the disclosure provide a liquid supply apparatus with an improved workability of cartridge attachment.

One or more aspects of the disclosure provide a liquid supply apparatus with an increased space for storing liquid relative to a space occupied by a cartridge and a tank.

According to one or more aspects of the disclosure, a liquid supply apparatus includes a tank and a cartridge attachable to and detachable from the tank along an attachment and detachment direction crossing a vertical direction. The cartridge includes a casing, a first storing chamber, and a communication port. The casing has a front surface and a rear surface in the attachment and detachment direction. The casing further has a surface adjacent to the front surface. The first storing chamber is located between the front surface, the surface adjacent to the front surface, and the rear surface of the casing. The first storing chamber is configured to store liquid therein. The communication port is formed in one of the front surface and the surface adjacent to the front surface. The communication port is open in an attachment direction parallel to the attachment and detachment direction to allow the first storing chamber to communicate with an outside of the cartridge. The tank includes a second storing chamber configured to store liquid therein, a liquid channel communicating with the second storing chamber, an air channel communicating with the second storing chamber, and an air communication port allowing the second storing chamber to communicate with an outside of the tank. The liquid channel has a first opening, a second opening, and a first extension portion. The first opening is formed at one end of the liquid channel and communicating with the second storing chamber. The second opening is formed at the other end, opposite to the one end, of the liquid channel and open to an outside. The first extension portion extends from the second opening in the attachment direction. The air channel has a third opening, a fourth opening, and a second extension portion. The third opening is formed at one end of the air channel and communicating with the second storing chamber. The fourth opening is formed at the other end, opposite to the one end, of the air channel and open to an outside. The second extension portion extends from the fourth opening in the attachment direction. When the cartridge is attached to the tank with the first storing chamber of the cartridge communicating with the second opening and the fourth opening of the tank, the first storing chamber of the cartridge has a portion located above the liquid channel and the air channel of the tank. The second storing chamber of the tank has a first area located above a lower end of the first storing chamber of the cartridge in the vertical direction and a second area continuous with the first area and located below the first storing chamber of the cartridge in the vertical direction. The third opening is located in the second area. The first storing portion of the cartridge stores an initial volume of liquid having a first liquid surface. The second storing portion of the tank stores liquid having a second liquid surface at the same level with the third opening. When viewed in the vertical direction, the first liquid surface partially overlaps the second liquid surface.

DETAILED DESCRIPTION

Figure 1A:
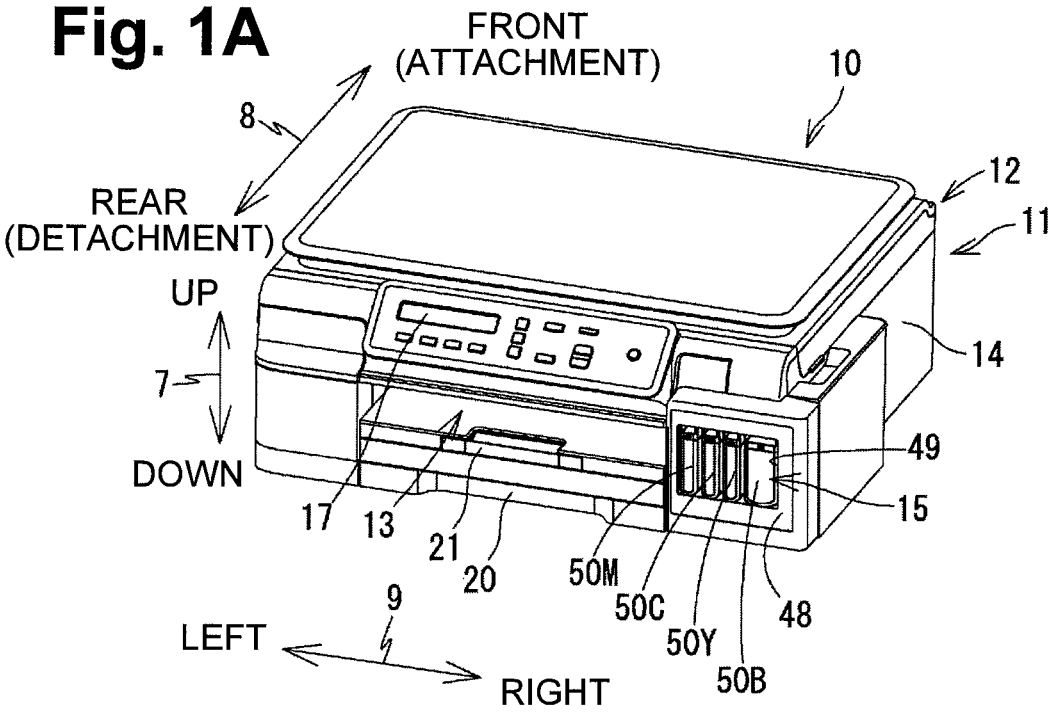
FIG. 1A is a perspective view of a multifunction apparatus with a cover at its closed position according to aspects of the disclosure.

Aspects of the disclosure will be described with reference to the accompany drawings. While the disclosure will be described in detail with reference to particular examples, various changes, arrangements and modifications may be applied therein without departing from the spirit and scope of the disclosure. In the following description, an up-down direction 7 is defined in conjunction with an orientation in which a multifunction apparatus 10 is placed on a horizontal surface or an ink cartridge 50 is attached to the multifunction apparatus 10 (which is an orientation illustrated in FIGS. 1A and 1B, and may refer to a use orientation). An attachment and detachment direction 8 is defined based on that a front surface of the multifunction apparatus 10 having an opening 13 is regarded as a surface facing rearward. A left-right direction 9 is defined when the multifunction apparatus 10 is viewed in an attachment direction 8A. In the use orientation in the following description, the up-down direction 7 corresponds to a vertical direction, and the attachment and detachment direction 8 and the left-right direction 9 correspond to a horizontal direction. Regarding the attachment and detachment direction 8, the same direction as the attachment direction 8A is referred to as front, and a direction opposite to the attachment direction 8 is referred to as rear.

Embodiment

The following describes the multifunction apparatus 10 and an ink supply apparatus 15 according to an illustrative embodiment.

Structure of Multifunction Apparatus 10

Figure 1B:
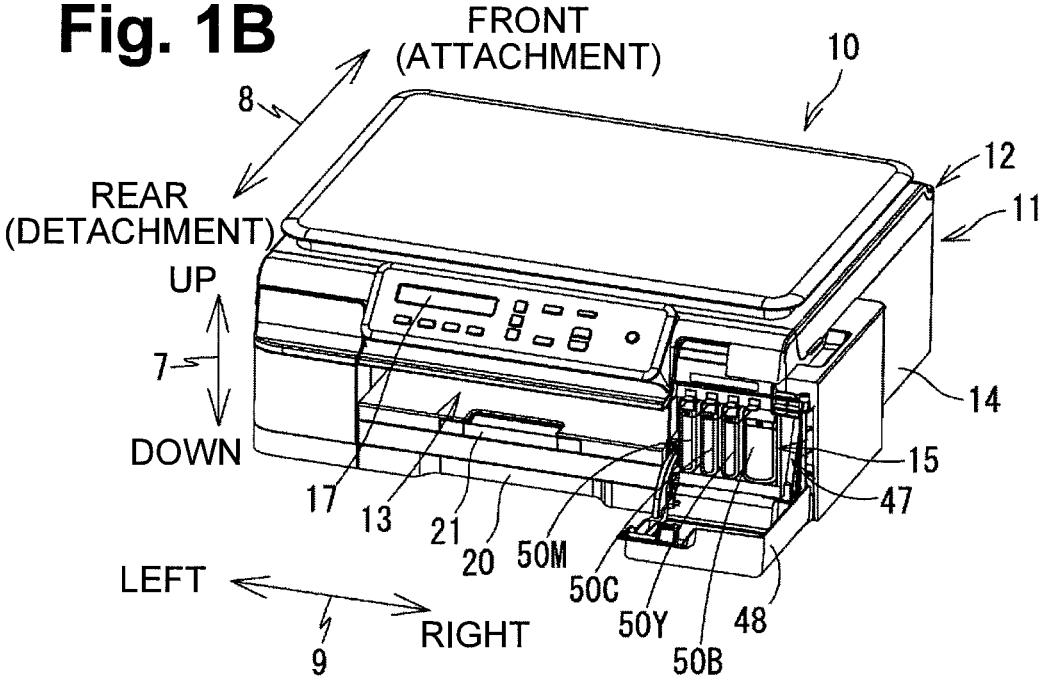
FIG. 1B is a perspective view of the multifunction apparatus with the cover at its open position according to aspects of the disclosure.

As illustrated in FIGS. 1A and 1B, the multifunction apparatus 10 (as an example of an image recording apparatus) is substantially box shaped. The multifunction apparatus 10 includes a printer 11, a scanner 12, and an operation panel 17. The printer 11 is disposed in a lower portion of the multifunction apparatus 10 and is configured to record an image on a sheet 28 (FIG. 2) using an inkjet recording method. The scanner 12 is a device with scan function and disposed above the printer 11. The printer 11 includes a casing 14 with an opening 13, and the ink supply apparatus 15, which is located to the right of the opening 13 in the casing 14. The operation panel 17 is located to the rear of the scanner 12 in the attachment and detachment direction 8. The operation panel 17 has user selection keys to cause the multifunction apparatus 10 to execute functions regarding image recording by the printer 11 and image reading by the scanner 12.

Figure 2:
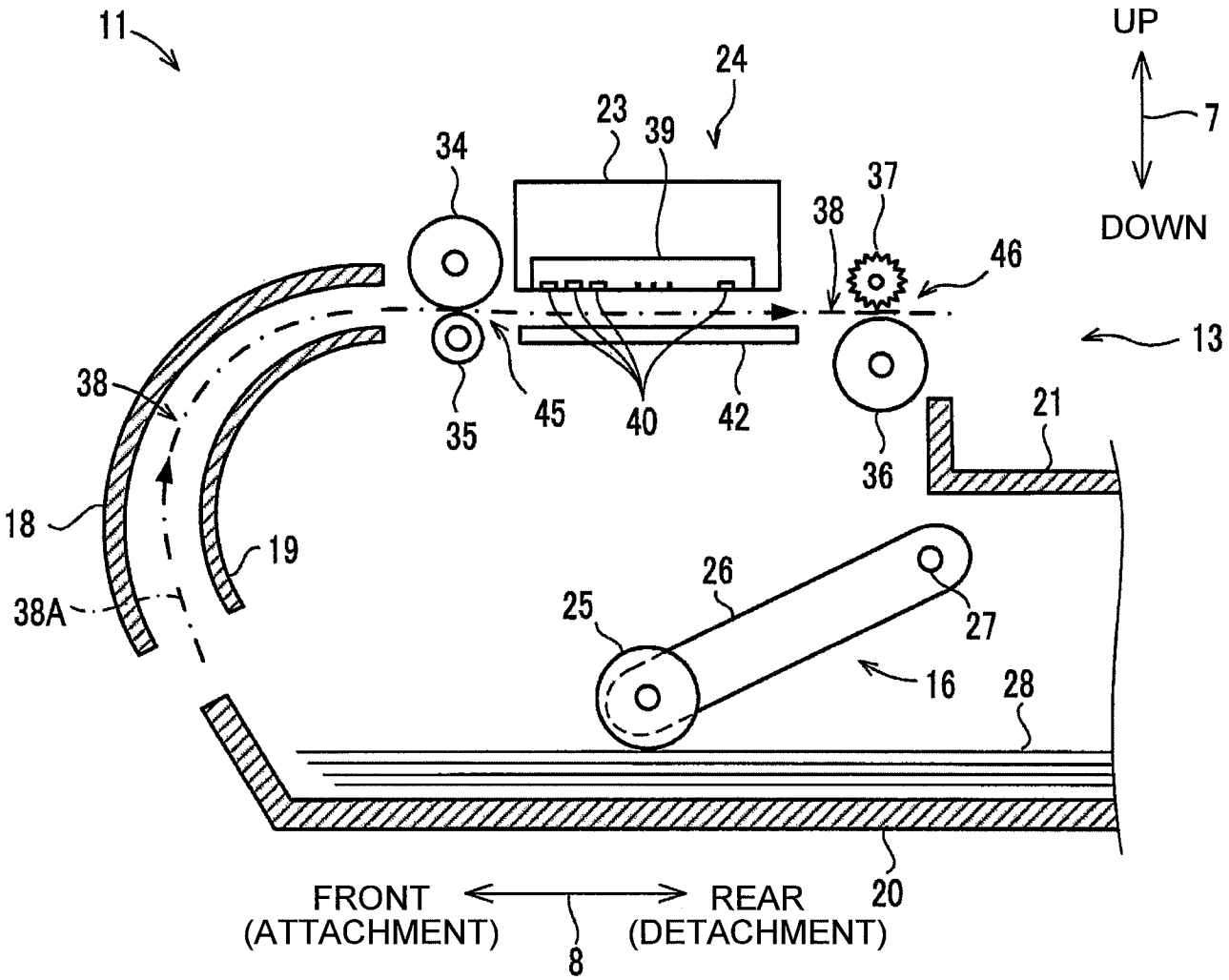
FIG. 2 is a sectional view schematically illustrating an internal configuration of a printer of the multifunction apparatus according to aspects of the disclosure.

As illustrated in FIG. 2, the printer 11 includes, in the casing 14, a feeder 16, a sheet feed tray 20, a sheet discharge tray 21, a conveying roller pair 45, a recording unit 24, a discharge roller pair 46, and a platen 42.

Sheet Feed Tray 20 and Sheet Discharge Tray 21

As illustrated in FIGS. 1A and 1B, the sheet feed tray 20 is insertable through the opening 13 into the casing 14. The opening 13 is defined in a surface facing rearward in the attachment and detachment direction 8 and in a central portion thereof in the left-right direction 9. As illustrated in FIG. 2, the sheet feed tray 20 is configured to support a stack of sheets 28. The sheet discharge tray 21 is disposed above the sheet feed tray 20 and is removable in the attachment and detachment direction 8 together with the sheet feed tray 20. The sheet discharge tray 21 supports a sheet 28 discharged by the discharge roller pair 46.

Feeder 16

The feeder 16 is configured to feed a sheet 28 supported on the sheet feed tray 20 toward a conveyance path 38. As illustrated in FIG. 2, the feeder 16 includes a feed roller 25, an arm 26 and a shaft 27. The feed roller 25 is rotatably supported at an end of the arm 26. The feed roller 25 receives a driving force from a motor, not illustrated. The arm 26 is pivotally supported by the shaft 27 supported by a frame of the printer 11. The arm 26 is urged by its own weight or an elastic force, for example, a spring, toward the sheet feed tray 20.

In the following description, when the feed roller 25, a conveying roller 34, and a discharge roller 36 each rotate about a respective rotational axis to convey a sheet 28 in a conveyance direction 38A, their rotation refers to forward rotation.

Conveyance Path 38

Figure 3:
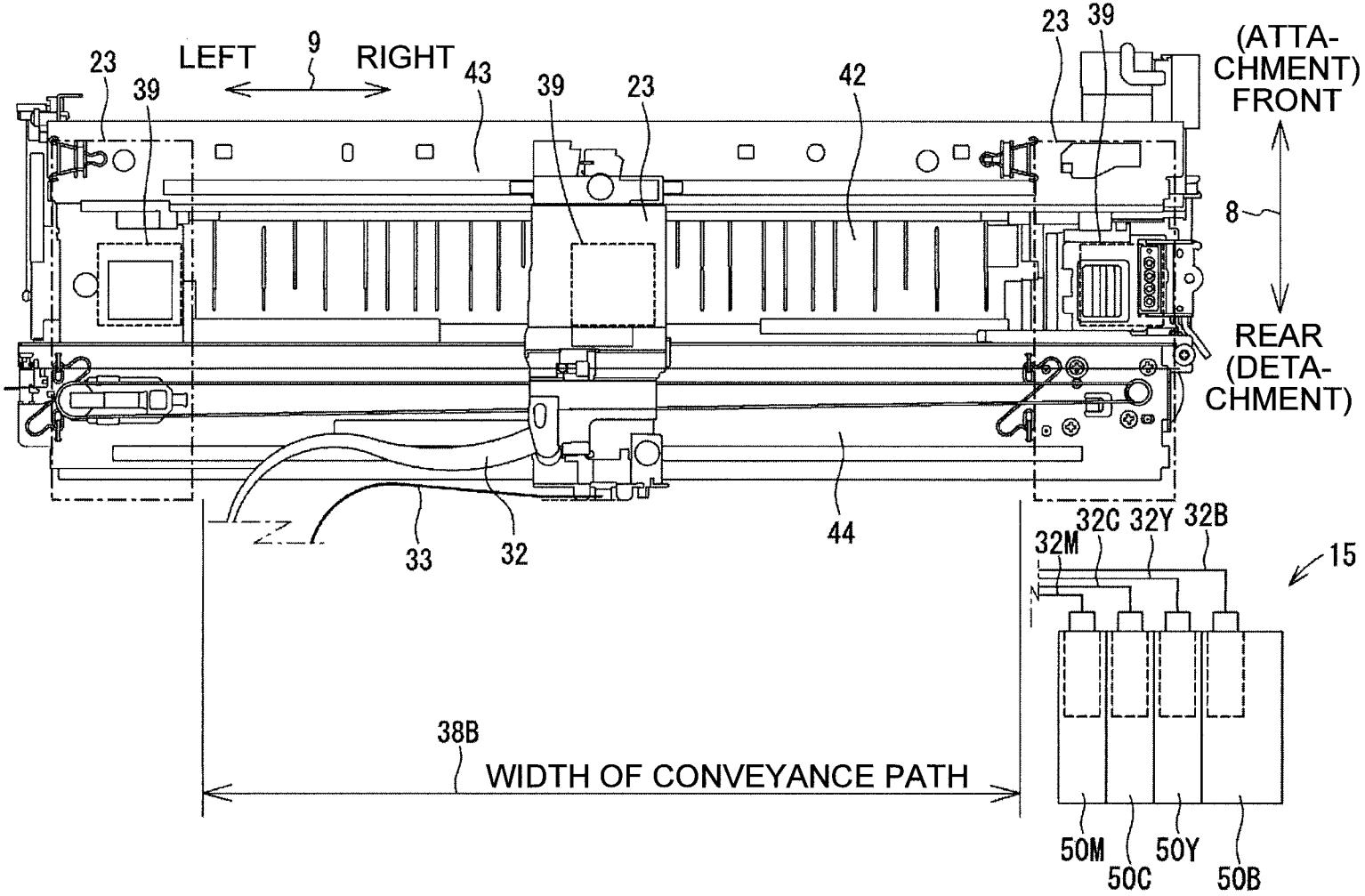
FIG. 3 is a plan view of a carriage and an ink supply apparatus according to aspects of the disclosure.

As illustrated in FIG. 2, the conveyance path 38 refers to a space partially defined in the printer 11 between an outer guide member 18 and an inner guide member 19 facing each other. The conveyance path 38 extends rearward from the sheet feed tray 20. The conveyance path 38 is curved upward from the sheet feed tray 20 and then rearward in the attachment and detachment direction 8, reaching the sheet discharge tray 21 via a space between the recording unit 24 and the platen 42. As illustrated in FIGS. 2 and 3, a portion of the conveyance path 38 extending between the conveying roller pair 45 and the discharge roller pair 46 is located at a central portion of the multifunction apparatus 10 in the left-right direction 9, and extends in the attachment and detachment direction 8. The conveyance direction 38A in the conveyance path 38 is indicated by an arrow in FIG. 2.

Conveyance Roller Pair 45

As illustrated in FIG. 2, the conveying roller pair 45 is disposed upstream from the recording unit 24 in the conveyance direction 38A. The conveyor roller pair 45 includes a conveying roller 34 and a pinch roller 35. The conveying roller 34 is configured to receive a driving force from a motor, not illustrated, and rotate in a forward or reverse direction. The pinch roller 35 is configured to rotate with the rotation of the conveying roller 34. A sheet 28 is pinched between the conveying roller 34 rotating in the forward direction and the pinch roller 35, and fed in the conveyance direction 38A.

Discharge Roller Pair 46

As illustrated in FIG. 2, the discharge roller pair 46 is disposed downstream from the recording unit 24 in the conveyance direction 38A. The discharge roller pair 46 includes a discharge roller 36 and a spur 37. The discharge roller 36 is configured to receive a driving force from a motor, not illustrated, and rotate in the forward or reverse direction. The spur 37 is configured to rotate with the rotation of the discharge roller 36. A sheet 28 is pinched between the discharge roller 36 rotating in the forward direction and the spur 37, and fed in the conveyance direction 38A.

Recording Unit 24

As illustrated in FIG. 2, the recording unit 24 is disposed between the conveying roller pair 45 and the discharge roller pair 46 in the conveyance direction 38A. The recording unit 24 faces downwardly toward the platen 42 via the conveyance path 38 in the up-down direction 7. The recording unit 24 includes the carriage 23 and a recording head 39 mounted on the carriage 23.

As illustrated in FIG. 3, the carriage 23 is supported by guide rails 43, 44, which are spaced apart from each other in the attachment and detachment direction 8 and each extend in the left-right direction 9. The guide rails 43, 44 are supported by a frame, not illustrated. The carriage 23 is connected to a known belt mechanism disposed on the guide rail 44. The belt mechanism includes a belt, which is configured to receive a driving force from a carriage-driving motor, not illustrated. The carriage 23 is guided by the guide rails 43, 44 along with the rotational movement of the belt, and reciprocates in the left-right direction 9. The carriage 23 moves to the left and right, as indicated by a dot-and-dash line in FIG. 3, beyond a width 38B of the conveyance path 38.

The recording head 39 is connected to four sub tanks 100 (FIG. 5) disposed in the ink supply apparatus 15 with four ink tubes 32. The recording head 39 is connected to a control circuit board, not illustrated, via a flexible flat cable 33.

The four sub tanks 100 includes a magenta sub tank 100, a cyan sub tank 100, a yellow sub tank 100, and a black sub tank 100. The magenta sub tank 100, cyan sub tank 100, yellow sub tank 100 and black sub tank 100 are collectively referred to as a sub tank 100 or sub tanks 100 unless otherwise specified in the following description.

The four ink tubes 32 includes a yellow ink tube 32Y, a cyan ink tube 32C, a magenta ink tube 32M, and a black ink tube 32B. The yellow ink tube 32Y, cyan ink tube 32C, magenta ink tube 32M, and black ink tube 32B are collectively referred to as an ink tube 32 or ink tubes 32 unless otherwise specified in the following description. The four ink tubes 32 are tied in a bundle.

The flexible flat cable 33 electrically connects the control circuit board having a controller mounted thereon and the recording head 39. The flexible flat cable 33 transmits a control signal outputted from the controller to the recording head 39.

As illustrated in FIG. 2, the recording head 39 has a lower surface formed with a plurality of nozzles 40. The nozzles 40 are exposed from the lower surface of the recording head 39. The recording head 39 ejects micro ink droplets from the nozzles 40. While the carriage 23 moves, the recording head 39 ejects ink droplets toward a sheet 28 supported by the platen 42. Thus, an image is recorded on the sheet 28. Ink stored in the four sub tanks 100 is consumed accordingly.

Platen 42

As illustrated in FIGS. 2 and 3, the platen 42 is disposed between the conveying roller pair 45 and the discharge roller pair 46 in the conveyance path 38. The platen 42 is disposed below and faces upwardly toward the recording unit 24 via the conveyance path 38 in the up-down direction 7. The platen 42 supports a sheet 28, which is conveyed by the conveying roller pair 45, from below.

Cover 48

As illustrated in FIG. 1B, the casing 14 has an opening 47 at a right portion of a surface facing rearward in the attachment and detachment direction 8. The casing 14 accommodates the ink supply apparatus 15, and ink cartridges 50 are illustrated as being exposed from the opening 47 at their rear walls 58. The casing 14 includes a cover 48 to open and close the opening 47. The cover 48 has its lower end supported below the opening 47 by the casing 14 such that the cover 48 is pivotable about a shaft extending in the left-right direction. The cover 48 is pivotable between a closed position (FIG. 1A) to close the opening 47 and an open position (FIG. 1B) to open the opening 47.

As illustrated in FIG. 1A, the cover 48 has a light-transmissive window 49. The light-transmissive window 49 is transparent to light to see inside from outside of the cover 48. When the cover 48 is at the closed position, the rear walls 58 of the ink cartridges 50 attached to the ink supply apparatus 15 are visible through the light-transmissive window 49.

Ink Supply Apparatus 15

Figure 5:
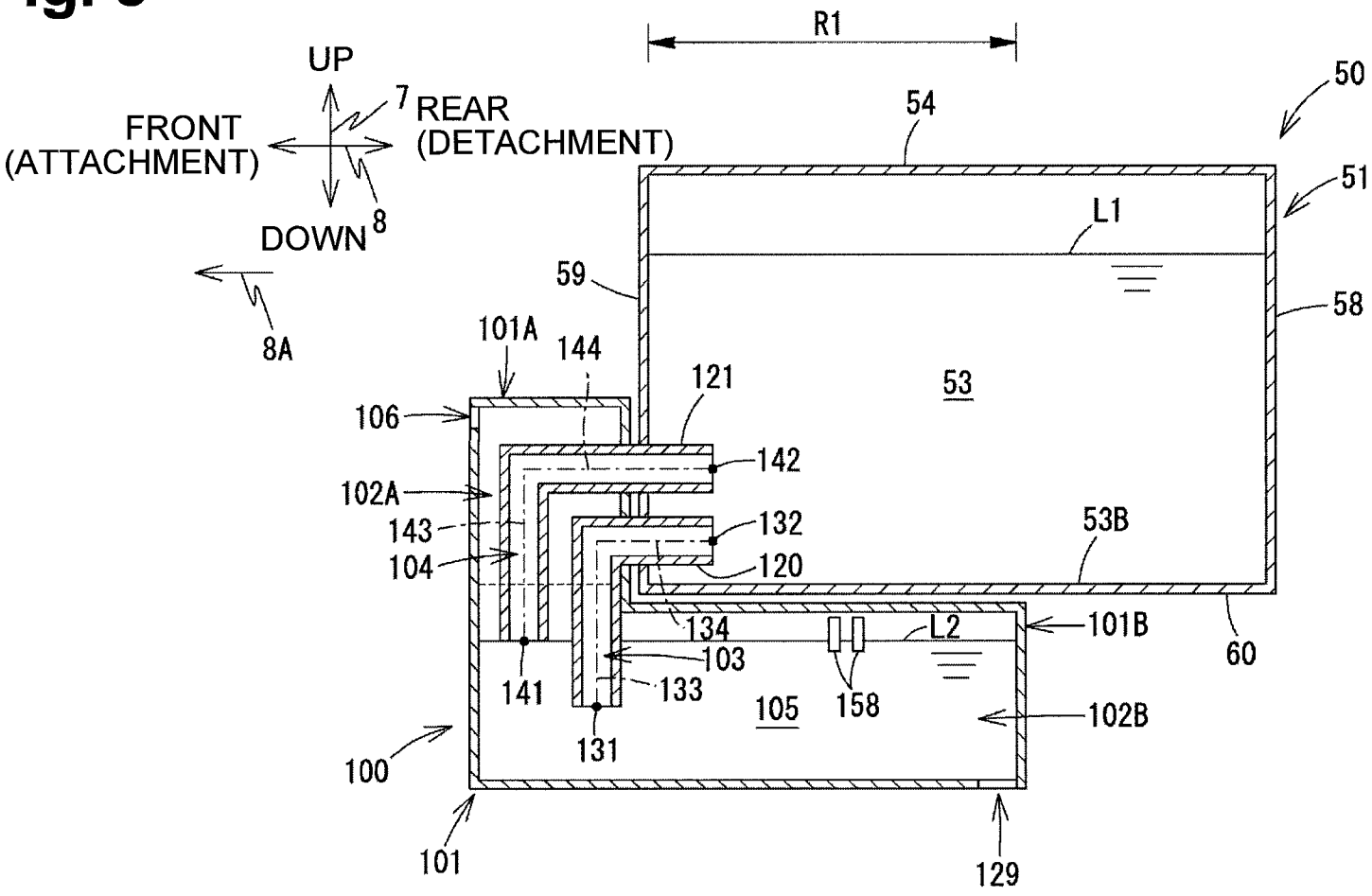
FIG. 5 is a sectional view of an ink cartridge and a sub tank, which are in an attached state, according to aspects of the disclosure.

As illustrated in FIG. 3, the ink supply apparatus 15 (as an example of a liquid supply apparatus) includes four ink cartridges 50 and four sub tanks 100 (FIG. 5).

Ink Cartridge 50

As illustrated in FIGS. 1A, 1B, and 3, four ink cartridges 50 (each as an example of a cartridge) include a magenta ink cartridge 50M, a cyan ink cartridge 50C, a yellow ink cartridge 50Y, and a black ink cartridge 50B. The magenta ink cartridge 50M, cyan ink cartridge 50C, yellow ink cartridge 50Y, and black ink cartridge 50B are collectively referred to as an ink cartridge 50 or ink cartridges 50 unless otherwise specified in the following description.

Figure 4:
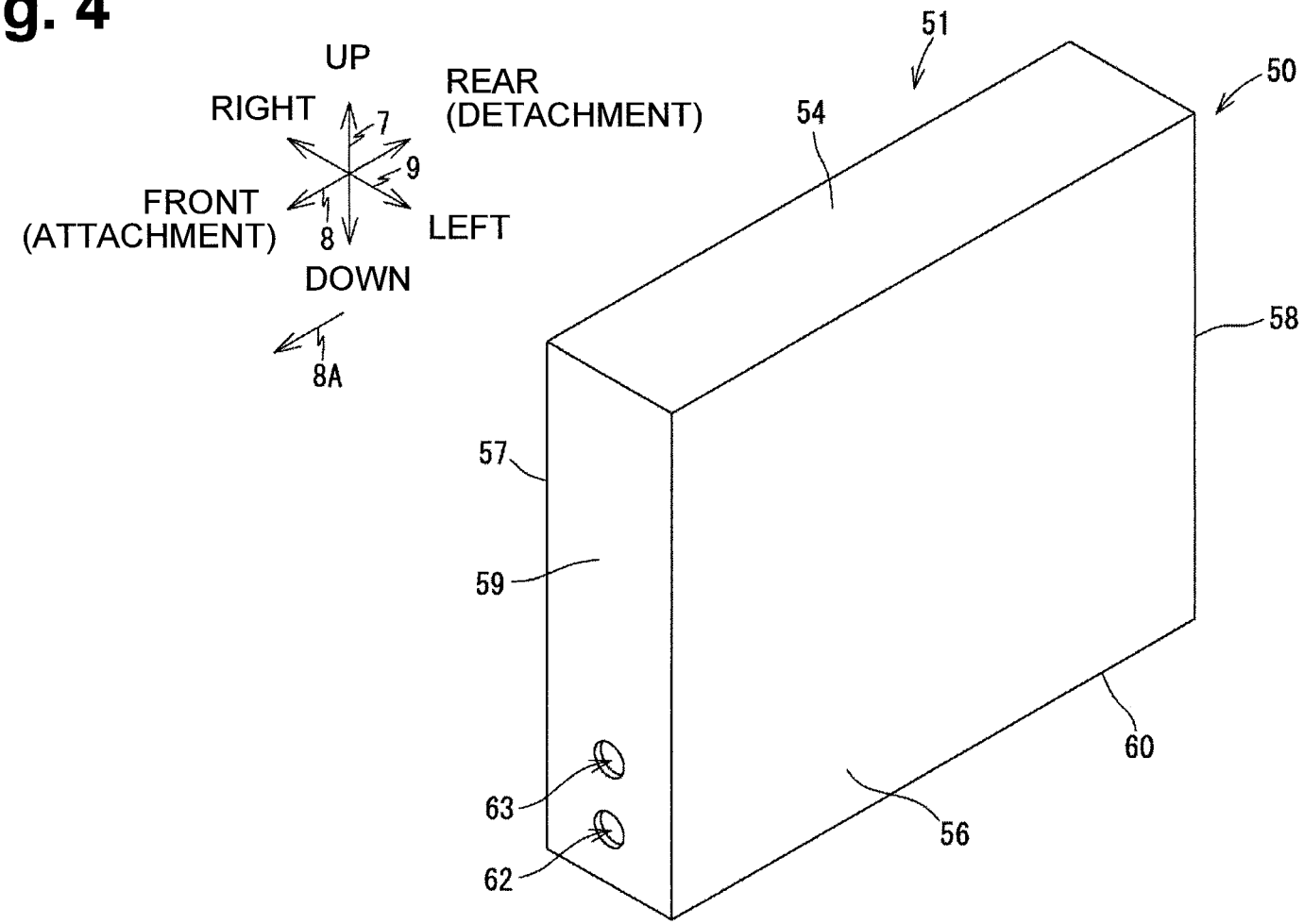
FIG. 4 is a perspective view of an ink cartridge according to aspects of the disclosure.

As illustrated in FIGS. 4 and 5, an ink cartridge 50 includes a cartridge casing 51. The cartridge casing 51 has a first storing chamber 53 for storing ink (as an example of liquid), and communication ports 62, 63.

The cartridge casing 51 is substantially box-shaped. The cartridge casing 51 is of a rectangle when viewed in the up-down direction 7 and when viewed in the attachment and detachment direction 8. The cartridge casing 51 has an upper wall 54, a right wall 57, a left wall 56, a rear wall 58, a front wall 59, and a lower wall 60. The upper wall 54 has an outer surface corresponding to an upper surface and the rear wall 58 has an outer surface corresponding to and a rear surface. The cartridge casing 51 has a front face facing in the attachment direction 8A. The first storing chamber 53 is located between the front wall 59 and the rear wall 58.

The cartridge casing 51 has the communication ports 62, 63 in the front wall 59. The communication ports 62, 63 are open in the attachment direction 8A. The communication port 62 is below the communication port 63. The communication ports 62, 63 allow the first storing chamber 53 to communicate with an outside of the ink cartridge 50. Although not illustrated, the communication ports 62, 63 are openable to the outside by known valves.

Sub Tank 100

As illustrated in FIG. 5, a sub tank 100 (as an example of a tank) includes a tank body 101 and joints 120, 121. The tank body 101 includes, inside, a second storing chamber 105 configured to store ink therein. The joints 120, 121 are shaped like a tube, and extend from the rear wall of the tank body 101 rearward in the attachment direction 8A or in a direction opposite to the attachment direction 8A. Each of the joints 120, 121 has an internal space communicating with the second storing chamber 105 via a respective through hole in the rear wall of the tank body 101. The joint 120 is below the joint 121.

The sub tank 100 includes a liquid channel 103 and an air channel 104, which communicate with the second storing chamber 105. The liquid channel 103 is defined inside the tank body 101 and the joint 120. The air channel 104 is defined inside the tank body 101 and the joint 121. The sub tank 100 includes an air communication port 106, which allows the second storing chamber 105 to communicate with an outside of the sub tank 100.

Liquid Channel 103 and Air Channel 104

The liquid channel 103 has a first opening 131, a second opening 132, a vertical portion 133, and an extension portion 134. The first opening 131 is formed at one end of the liquid channel 103 and communicates with the second storing chamber 105. The first opening 131 is open downward in the up-down direction 7. The second opening 132 is formed at the other end of the liquid channel 103 and is open to an outside of the sub tank 100. The second opening 132 is open toward the rear along the attachment and detachment direction 8. The second opening 132 is located inside the first storing chamber 53 of the ink cartridge 50 attached to the sub tank 100. The vertical portion 133 defines a portion of the liquid channel 103, extending upward from the first opening 131. The extension portion 134 (as an example of a first extension portion) defines a portion of the liquid channel 103, extending from the second opening 132 in the attachment direction 8A. The vertical portion 133 has its upper end connected to the front end of the extension portion 134.

The air channel 104 has a third opening 141, a fourth opening 142, a vertical portion 143, and an extension portion 144. The third opening 141 is formed at one end of the air channel 104 and communicates with the second storing chamber 105. The third opening 141 is open downward in the up-down direction 7. The fourth opening 142 is formed at the other end of the air channel 104 and is open to an outside of the sub tank 100. The fourth opening 142 is open toward the rear along the attachment and detachment direction 8. The fourth opening 142 communicates with the first storing chamber 53 of the ink cartridge 50 attached to the sub tank 100. The vertical portion 143 defines a portion of the air channel 104, extending upward from the third opening 141. The extension portion 144 (as an example of a second extension portion) defines a portion of the air channel 104, extending from the fourth opening 142 in the attachment direction 8A. The vertical portion 143 has its upper end connected to the front end of the extension portion 144.

Tank Body 101

The tank body 101 is box-shaped and has an upper portion 101A and a lower portion 101B. The upper portion 101A is on top of a front portion of the lower portion 101B in the attachment direction 8A. The upper portion 101A has an internal space 102A (as an example of a first area). When the ink cartridge 50 is attached to the sub tank 100, the internal space 102A is above a lower end 53B of the first storing chamber 53. The lower portion 101B has an internal space 102B (as an example of a second area). When the ink cartridge 50 is attached to the sub tank 100, the internal space 102B is below the lower end 53B of the first storing chamber 53. The internal space 102A of the upper portion 101A and the internal space 102B of the lower portion 101B are continuous with each other, forming the second storing chamber 105. The internal space 102A has a volume Va greater than a volume Vb of the internal space 102B (Va<Vb).

The lower portion 101B of the sub tank 100 has a lower wall formed with a communication port 129, which communicates with the second storing chamber 105. The communication port 129 receives one end of the ink tube 32, which allows the second storing chamber 105 to communicate with the recording head 39.

The upper portion 101A of the tank body 101 has a front wall formed with the air communication port 106 passing therethrough near its upper end. The second storing chamber 105 communicates with an outside of the sub tank 100 via the air communication port 106.

The tank body 101 has, in its internal space, partition walls and tubes, which define a portion of the liquid channel 103 including the vertical portion 133. The liquid channel 103 has the first opening 131 in the internal space 102B of the lower portion 101B. The tank body 101 has, in its internal space, partition walls and tubes, which define a portion of the air channel 104 including the vertical portion 143. The third opening 141 of the air channel 104 is in the internal space 102B of the lower portion 101B. The third opening 141 of the air channel 104 is located above the first opening 131 of the liquid channel 103.

Attached State of Ink Cartridge 50

As illustrated in FIG. 5, the ink cartridge 50 is attached to the sub tank 100 with the joint 120 of the sub tank 100 inserted into the communication port 62 of the ink cartridge 50 along the attachment and detachment direction 8. The joint 121 of the sub tank 100 is inserted into the communication port 63 of the ink cartridge 50 along the attachment and detachment direction 8. In the attached state, the second opening 132 of the liquid channel 103 of the sub tank 100 is located in the first storing chamber 53 of the ink cartridge 50. The fourth opening 142 of the air channel 104 of the sub tank 100 is located in the first storing chamber 53 of the ink cartridge 50. The ink cartridge 50 is attachable to and detachable from the sub tank 100 along the attachment and detachment direction 8.

Layout of Ink Cartridge 50 and Sub Tank 100

The following describes a layout of the ink cartridge 50 and the sub tank 100 based on that the ink cartridge 50 and the sub tank 100 which are at the use orientation illustrated in FIG. 5.

As illustrated in FIG. 5, the upper portion 101A of the tank body 101 faces the front wall 59 of the ink cartridge 50 in the attachment and detachment direction 8. The lower portion 101B of the tank body 101 is located below the lower wall 60 of the ink cartridge 50 in the up-down direction 7.

Most part of the first storing chamber 53 is located above the extension portion 134 of the liquid channel 103 and the extension portion 144 of the air channel 104. The lower portion of the first storing chamber 53 and the internal space 102A of the upper portion 101A of the tank body 101 are aligned in the attachment and detachment direction 8. The first storing chamber 53 has a greater capacity than the second storing chamber 105 has.

The internal space 102A of the upper portion 101A of the tank body 101 is located at a position overlapping, in the up-down direction 7, a portion of the extension portion 134 of the liquid channel 103 and a portion of the extension portion 144 of the air channel 104. The internal space 102B of the lower portion 101B of the tank body 101 is located below the extension portion 134 of the liquid channel 103 and the extension portion 144 of the air channel 104 in the up-down direction 7.

The extension portion 144 of the air channel 104 is located above the extension portion 134 of the liquid channel 103.

As illustrated in FIG. 5, the first storing chamber 53 stores an initial volume of ink having a liquid surface L1 (as an example of a first liquid surface), and the second storing chamber 105 stores ink having a liquid surface L2 (as an example of a second liquid surface) at the same level with the third opening 141 of the air channel 104. When viewed in the up-down direction 7, the liquid surface L1 partially overlaps the liquid surface L2. In FIG. 5, a range R1 in the attachment and detachment direction 8 indicates an overlap between the liquid surface L1 and the liquid surface L2.

Flows of Ink and Air

The following describes flows of ink and air between the ink cartridge 50 and the sub tank 100 in an initial-ink-supply operation when the ink cartridge 50 is attached to the empty sub tank 100 for the first time.

Before the initial-ink-supply operation, the ink cartridge 50 is not attached to the sub tank 100. At this time, the first storing chamber 53 stores an initial volume of ink whose surface is the liquid surface L1. The second storing chamber 105 stores no ink or is empty.

As illustrated in FIG. 5, when the ink cartridge 50 is attached to the sub tank 100 in the attachment direction 8A, the communication port 62 of the ink cartridge 50 receives the joint 120 of the sub tank 100, and the communication port 63 of the ink cartridge 50 receives the joint 121 of the sub tank 100. The lower portion of the first storing chamber 53 thus communicates with the second storing chamber 105 via the liquid channel 103. The lower portion of the first storing chamber 53 communicates with the second storing chamber 105 via the air channel 104. This allows ink in the first storing chamber 53 of the ink cartridge 50 to naturally flow down into the second storing chamber 105 via the liquid channel 103. Air with the same volume of ink having flowed into the second storing chamber 105 flows into the first storing chamber 53 via the air channel 104. Thus, ink in the first storing chamber 53 is replaced with air (air/liquid replacement), and supplied to the second storing chamber 105.

The ink level in the second storing chamber 105 rises as the ink in the first storing chamber 53 flows into the second storing chamber 105. The ink level rises until the ink closes the third opening 141 of the air channel 104. While the ink closes the third opening 141, the ink in the first storing chamber 53 does not flow into the second storing chamber 105. At this time, the second storing chamber 105 stores ink whose surface is the liquid surface L2. This is how the ink is supplied in the initial-ink-supply operation. While ink is left between ink detection plates 158, electric current flows between the ink detection plates 158. Thus, detecting the electric current flow may indicate that the ink level in the second storing chamber 105 has risen to a predetermined level.

The following describes flows of ink and air between the ink cartridge 50 and the sub tank 100 when the printer 11 performs recording while the ink cartridge 50 is attached to the sub tank 100.

During recording, as ink is ejected from the recording head 39, ink in the second storing chamber 105 is drawn through the communication port 129 to the recording head 39. As ink in the second storing chamber 105 decreases, the ink level lowers away from the third opening 141 of the air channel 104, air corresponding to a volume of the decreased ink is drawn through the air communication port 106 to the second storing chamber 105, and the third opening 141 of the air channel 104 is released. Then, ink to compensate the decreased ink is supplied from the first storing chamber 53 to the second storing chamber 105 as the same volume of air flows out from the second storing chamber 105 through the third opening 141. Thus, the liquid surface L2 in the second storing chamber 105 is maintained at the level of the third opening 141 of the air channel 104. In this manner, the air/liquid replacement continuously occurs.

After the ink level in the first storing chamber 53 becomes lower below the second opening 132, the ink level in the second storing chamber 105 gradually lowers every time ink is ejected from the recording head 39, and the third opening 141 of the air channel 104, which has been closed by ink, is released. When the ink level in the second storing chamber 105 further lowers until no ink is left between the ink detection plates 158, no or lower electric current flows between the ink detection plates 158. Thus, detecting no or lower electric current flow may indicate that the ink level in the second storing chamber 105 has lowered to a predetermined level so that the multifunction apparatus 10 outputs information that the first storing chamber 53 of the ink cartridge 50 becomes "empty" though a little ink remains below the second opening 132 in the first storing chamber 53. The "empty" ink cartridge 50 is replaced with a new one filled with ink, and the multifunction apparatus 10 can thus performs recording operation thereafter.

Effects

The first storing chamber 53 and the second storing chamber 105 are connected to each other via the liquid channel 103 and the air channel 104, and ink in the first storing chamber 53 can be supplied to the second storing chamber 105 by the air/liquid replacement. The ink cartridge 50 can be attached to the sub tank 100 along the attachment and detachment direction 8 crossing the vertical direction. This provides improved workability for attachment and detachment of the ink cartridge 50. The communication ports 62, 63 are formed in the front wall 59 of the cartridge casing 51, and thus the lower wall 60 of the cartridge casing 51 can be entirely used as a surface to be placed on to stabilize the position of the cartridge casing 51. When the ink cartridge 50 is attached to the sub tank 100, the liquid surface L1 and the liquid surface L2 partially overlap each other when viewed in the up-down direction 7. This overlap provides increased volumes of the first storing chamber 53 and the second storing chamber 105 relative to the respective spaces occupied by the ink cartridge 50 and the sub tank 100.

In the sub tank 100, the volume Va of the internal space 102A of the upper portion 101A is smaller than the volume Vb of the internal space 102B of the lower portion 101B. This provides a decreased dimension of the second storing chamber 105 in the attachment and detachment direction 8. The volume Vb is greater than the volume Va. In the attached state, the second storing chamber 105 located below the first storing chamber 53 can be thus used as a space where ink can be stored.

Alternative Embodiment

The ink supply apparatus 15 is attached and detached horizontally in the attachment and detachment direction 8. The attachment and detachment direction 8 may be a direction crossing the horizontal direction and the vertical direction. In an example illustrated in FIG. 6, the attachment and detachment direction 8 is a direction crossing the vertical direction and the horizontal direction, and the attachment direction 8A is directed diagonally downward.

In this example, the cartridge casing 51 of the ink cartridge 50 has an inclined wall 55 continuous with the front wall 59 and the lower wall 60. The inclined wall 55 faces diagonally downward in the attachment direction 8A. The inclined wall 55 may has an outer surface (an example of a surface adjacent to the front surface) continuous with an outer surface (front surface) of the front wall 59.

The tank body 101 has an inclined wall 107 to face the inclined wall 55 when the ink cartridge 50 is attached to the sub tank 100. Joints 120, 121 protrude from the inclined wall 107 along the attachment and detachment direction 8. The extension portions 134, 144, which are defined by respective internal spaces of the joints 120, 121, extend in the attachment and detachment direction 8, which crosses the horizontal direction. The extension portion 144 is located above the extension portion 134 relative to a position in the attachment and detachment direction 8 (or a position on an imaginary line parallel to the attachment and detachment direction 8).

Figure 6:
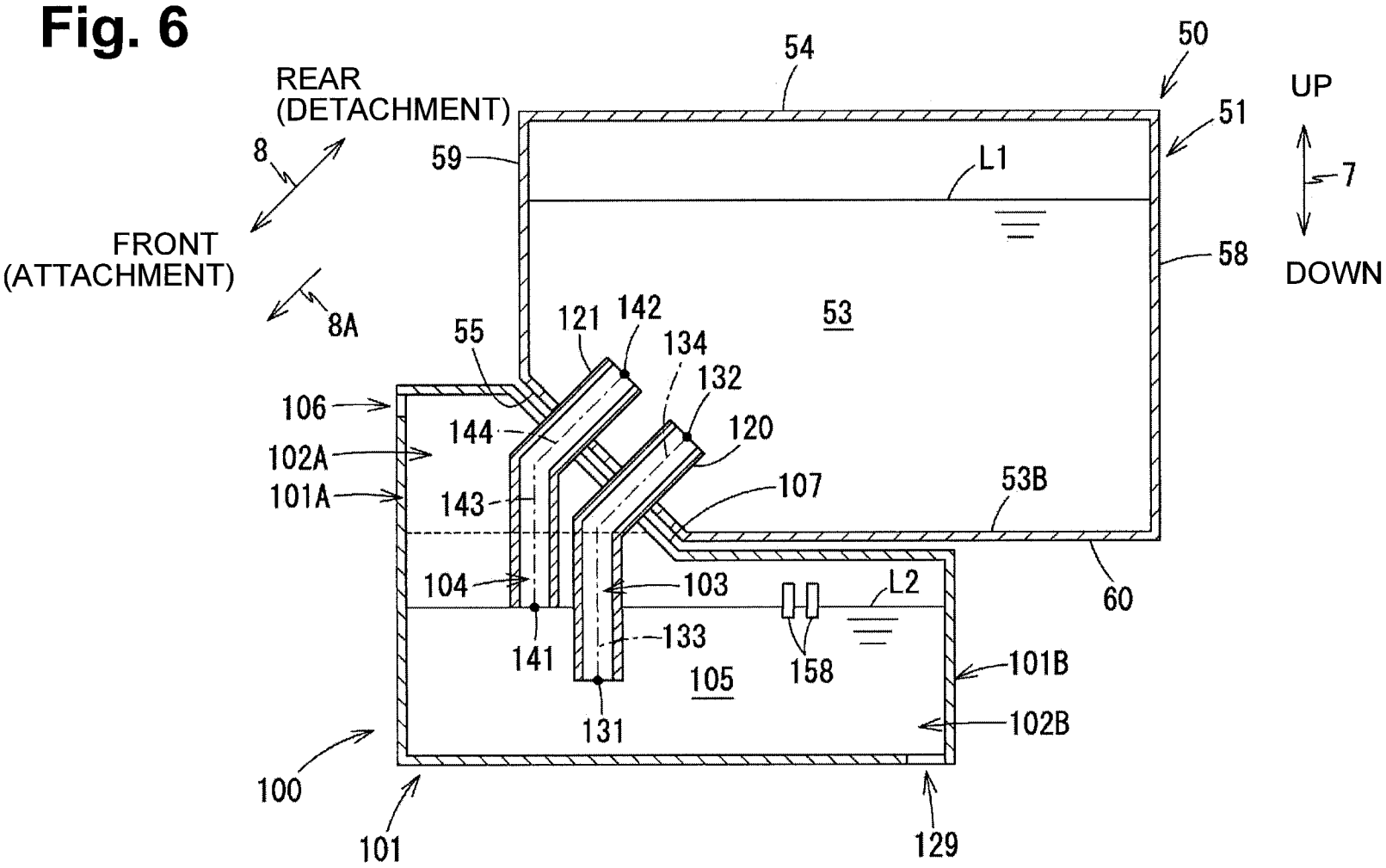
FIG. 6 is a sectional view of an ink cartridge and a sub tank, which are in an attached state, according to aspects of the disclosure.

In the above-described configurations in FIGS. 5 and 6, the joint 120 defining the liquid channel 103 and the joint 121 defining the air channel 104 are provided as independent tubes. According to one or more aspects, a single tube may define a single joint having separate compartments within it such that one compartment defines the liquid channel 103 and the other one compartment defines the air channel 104.

In the above ink supply apparatus 15, the liquid channel 103 has the vertical portion 133 and the extension portion 134, and the air channel 104 has the vertical portion 143 and the extension portion 144. According to one or more aspects, the liquid channel 103 may have the extension portion 134 only, that is, may not have the vertical portion 133. Similarly, the air channel 104 may have the extension portion 144 only, that is, may not have the vertical portion 143. The extension portion 134 of the liquid channel 103 may be located above the extension portion 144 of the air channel 104.

In the above-described configuration in FIG. 5, the first storing chamber 53 has a greater capacity than the second storing chamber 105. The first storing chamber 53 may be identical in capacity to the second storing chamber 105 or have a smaller capacity than the second storing chamber 105.

What is claimed is:

1. A liquid supply apparatus, comprising:

a tank; and a cartridge attachable to and detachable from the tank along an attachment and detachment direction crossing a vertical direction, the cartridge including:

a casing having a front surface and a rear surface in the attachment and detachment direction, the casing having a surface adjacent to the front surface;

a first storing chamber located between the front surface, the surface adjacent to the front surface, and the rear surface of the casing, the first storing chamber being configured to store liquid therein; and a communication port formed in at least one of the front surface and the surface adjacent to the front surface, the communication port being open in an attachment direction parallel to the attachment and detachment direction to allow the first storing chamber to communicate with an outside of the cartridge, wherein the tank includes:

a second storing chamber configured to store liquid therein;

a liquid channel communicating with the second storing chamber;

an air channel communicating with the second storing chamber; and an air communication port allowing the second storing chamber to communicate with an outside of the tank, wherein the liquid channel has a first opening, a second opening, and a first extension portion, the first opening being formed at one end of the liquid channel and communicating with the second storing chamber, the second opening being formed at the other end, opposite to the one end, of the liquid channel and open to an outside, the first extension portion extending from the second opening in the attachment direction, wherein the air channel has a third opening, a fourth opening, and a second extension portion, the third opening being formed at one end of the air channel and communicating with the second storing chamber, the fourth opening being formed at the other end, opposite to the one end, of the air channel and open to an outside, the second extension portion extending from the fourth opening in the attachment direction, wherein, when the cartridge is attached to the tank with the first storing chamber of the cartridge communicating with the second opening and the fourth opening of the tank, the first storing chamber of the cartridge has a portion located above the liquid channel and the air channel of the tank, the second storing chamber of the tank has a first area located above a lower end of the first storing chamber of the cartridge in the vertical direction and a second area continuous with the first area and located below the first storing chamber of the cartridge in the vertical direction, the third opening is located in the second area, the first storing chamber of the cartridge stores an initial volume of liquid having a first liquid surface, the second storing chamber of the tank stores liquid having a second liquid surface at the same level with the third opening, and when viewed in the vertical direction, the first liquid surface partially overlaps the second liquid surface.

2. The liquid supply apparatus according to claim 1, wherein the first area has a volume smaller than a volume of the second area.

3. The liquid supply apparatus according to claim 1, wherein the first storing chamber has a greater capacity than the second storing chamber has.

4. The liquid supply apparatus according to claim 1, wherein the tank includes a joint defining at least one of the first extension portion and the second extension portion, the joint being configured to, when the cartridge is attached to the tank, connect with the communication port of the cartridge.

5. The liquid supply apparatus according to claim 1, wherein the attachment and detachment direction further crosses a horizontal direction.

6. The liquid supply apparatus according to claim 1, wherein the attachment and detachment direction is a horizontal direction.

7. An image recording apparatus comprising:

the liquid supply apparatus according to claim 1; and a recording unit including a recording head connected to the tank of the liquid supply apparatus, the recording unit being configured to eject the liquid supplied from the tank.

* * * * *